US006179089B1

(12) United States Patent
Bishop

(10) Patent No.: US 6,179,089 B1
(45) Date of Patent: Jan. 30, 2001

(54) BELOW THE SCANNER (BTS) NESTING CHECK STAND/CART SYSTEM

(76) Inventor: Dennis Michael Bishop, 230 E. Scawall Blvd., Galveston, TX (US) 77550

( * ) Notice: Under 35 U.S.C. 154(b), the term of this patent shall be extended for 0 days.

(21) Appl. No.: 09/361,397

(22) Filed: Jul. 26, 1999

(51) Int. Cl.[7] ..... A63F 9/02
(52) U.S. Cl. ..... 186/61; 186/62
(58) Field of Search ..... 186/61–65

(56) References Cited

U.S. PATENT DOCUMENTS

| | | | | |
|---|---|---|---|---|
| 3,443,665 | * | 5/1969 | Zschaech | 186/65 |
| 3,517,773 | | 6/1970 | Swanson | 186/63 |
| 3,789,957 | * | 2/1974 | Close | 186/63 |
| 4,007,809 | * | 2/1977 | Goransson | 186/63 |
| 4,043,426 | * | 8/1977 | Verkler | 186/61 |
| 4,105,096 | * | 8/1978 | Baugh et al. | 186/63 |
| 4,177,880 | * | 12/1979 | Joseloff | 186/63 |
| 4,373,611 | * | 2/1983 | Frederick | 186/64 |

FOREIGN PATENT DOCUMENTS

| | | | | |
|---|---|---|---|---|
| 136525 | * | 4/1985 | (EP) | 186/62 |

OTHER PUBLICATIONS

Reynolds Corp. brochure Scan2100 Checker Unload front and back No Date.

* cited by examiner

*Primary Examiner*—Robert P. Olszewski
*Assistant Examiner*—Thuy V. Tran

(57) ABSTRACT

A check stand having a cantilevered scanner housing using (10) combined with a shopping cart having a cart basket bottom (16) which passes beneath the cantilevered scanner housing to create a nested check stand and cart combined system. The shopping cart having a angled drop-down front gate (20) which opens to allow the cart basket bottom (16) to pass beneath the cantilevered scanner housing (10).

2 Claims, 8 Drawing Sheets

BELOW THE SCANNER (BTS) NESTING CHECK STAND/CART SYSTEM

BACKGROUND

1. Field of Invention

This invention relates to a checker unload supermarket check stand and a shopping cart that combined create a new system for retailers.

2. Description of Prior Art

A checker unload check stand system in a grocery store uses a main counter and cart. A customer pushes the shopping cart to the front of the main counter where the checker takes control of cart. The checker removes the items from the shopping cart and scans or key enters item prices. The checker then passes the checked items to the rear of the counter via manual reach or a power take away belt.

U.S. Pat. No. 3,517,773 to R. K. Swanson details an earlier attempt to combine a check stand and cart into a full system. In this patent a check out system combined a cantilevered counter with a cantilevered cart that passed over the top of the counter. This system was successful for many years before scanning was introduced into the grocery store industry. When check stands began to incorporate an optical scanner into the main counter several problems became evident. The front of the cart was required to stop prior to the scanner head making it necessary for a checker to reach the full length of the shopping cart to reach product thus increasing body stress. Since the cart basket bottom passed over the top of the check stand the surface of the counter was very low. A checker now needed to bend over to pass items over the scanner head creating additional body stress.

With the advent of scanning in the 1970's several checker unload systems have been developed and marketed. These systems all have the front of the shopping cart stopping at the front edge of the check stand and before the cart reaches the scanner. This type system requires the checker to reach farther and farther toward the rear of the cart to retrieve items as the basket of the cart is emptied. This type system while workable and in common use in the supermarket industry has serious drawbacks. Checker body stress is increased the farther they reach into the cart to obtain product. The time to unload a cart and process a customer order is increased because of this long reach.

The prior art provided in literature form illustrates the blunt front of the check stand where the shopping cart stops. It also illustrates where the cart docks in front of the scanner. The cart is then in a stationary position while the checker unloads the cart and scans the product. This stationary position of the cart requires the checker to reach the full length of the cart to retrieve product.

Thus, there is a need for a check out stand and cart combination that creates less reach for the checker.

There is no prior art or patent that refers to my invention.

OBJECTS AND ADVANTAGES

Accordingly, several objects and advantages of the below the scanner nesting check stand/cart system are:

Current systems require checkers to reach the full length of the shopping cart to reach items before passing them over the scanner. With the below the scanner system in my invention the reach factor for the checker is reduced by over fifty percent. This reach reduction is attained by the bottom of the cart passing under the cantilevered scanner housing during the checkout process.

Current systems create more body stress on checkers because of the long reach factors. The below the scanner system brings the product in the shopping cart closer to the checker. Body movement and reach is reduced creating less body stress on the checker.

My invention allows the checker to spend less time processing a customer order. Having all product within easy reach of the checker reduces the time needed to scan individual items. My invention will allow checkers to process more orders with less body stress during a workday All of the objects and advantages and additional advantages will become apparent from consideration of the ensuing description and drawings.

REFERENCE NUMERALS IN DRAWINGS

Figure 1:
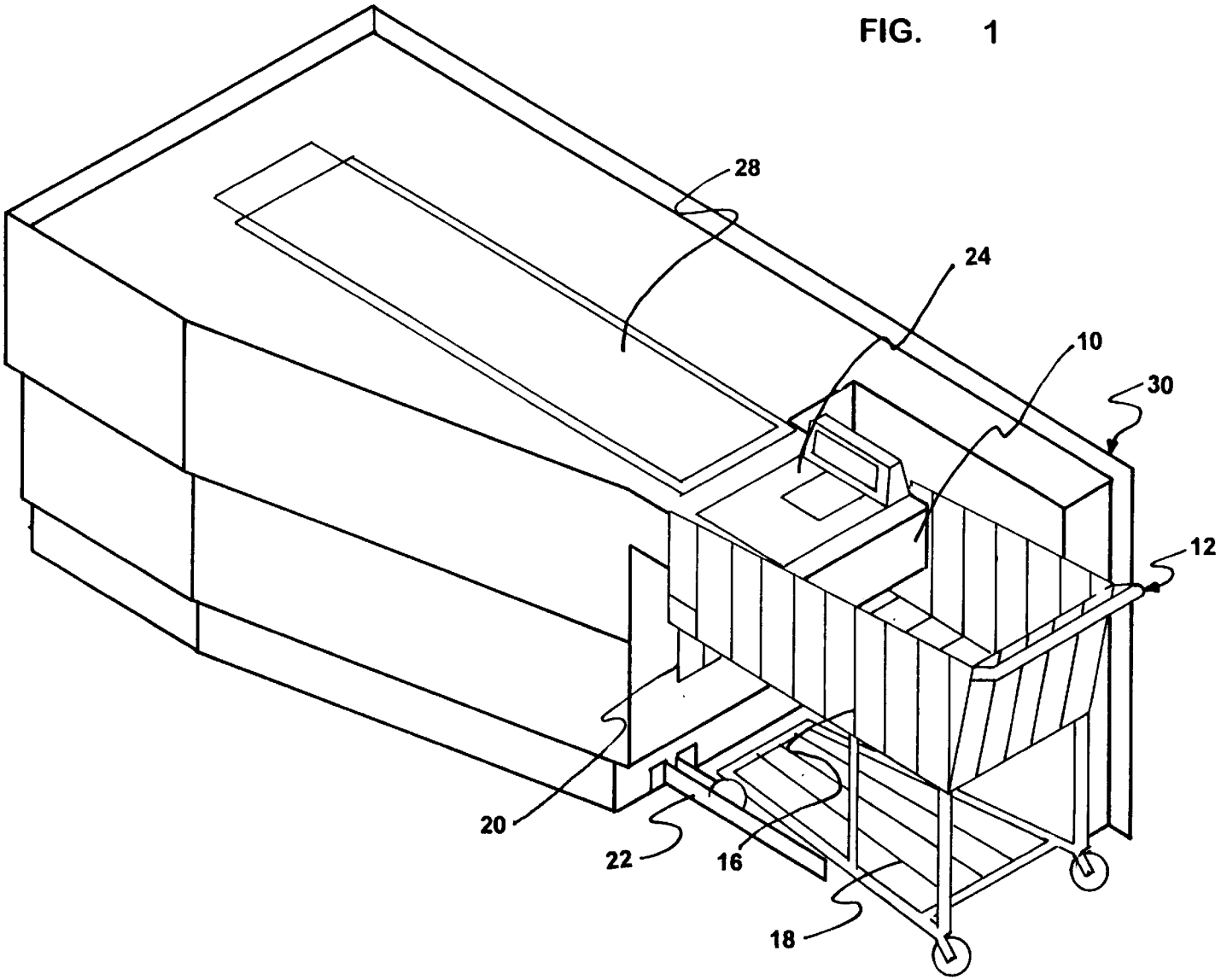
FIG. 1 is a perspective view of the BTS (below the scanner) system showing the check stand with the cart in an extended position under the cantilevered scanner housing.

10 cantilevered scanner housing
12 BTS narrow mouth conventional nesting cart
14 BTS wide mouth over-the-end cart
16 cart basket bottom
18 cart bottom tray
20 angled drop-down cart front gate
22 wheel capture cart guide
24 short scanner
26 deep scanner
28 power take away belt
30 BTS check stand

SUMMARY

In accordance with the present invention a check stand having a cantilevered scanner housing combined with a shopping cart with a basket bottom that passes beneath the cantilevered scanner housing to form a complete system. In effect the check stand and cart nest together as the cantilevered scanner housing is surrounded by the shopping cart during the product scanning operation.

Description

FIGS. 1 to 8

FIG. 1 is a perspective view of the invention. The BTS shopping cart 12 is shown extended under the cantilevered scanner housing 10. The reader can see the bottom of the cart basket 16 passes under the cantilevered scanner housing 10. A short scanner 24 is shown recessed inside the cantilevered scanner housing 10. A power take-away belt 28 aids in moving the scanned product to the rear of the checkstand. The angled drop-down cart front gate 20 when lowered allows the cart to pass under and surround the cantilevered scanner housing 10. The cart bottom tray 18 is shown in an extended position under the cantilevered scanner housing 10. The wheel capture guide 22 guides the cart wheel in a straight line to allow the cart 12 to pass under the cantilevered scanner housing 10 without contact between the cart sides and the cantilevered scanner housing sides.

Figure 2:
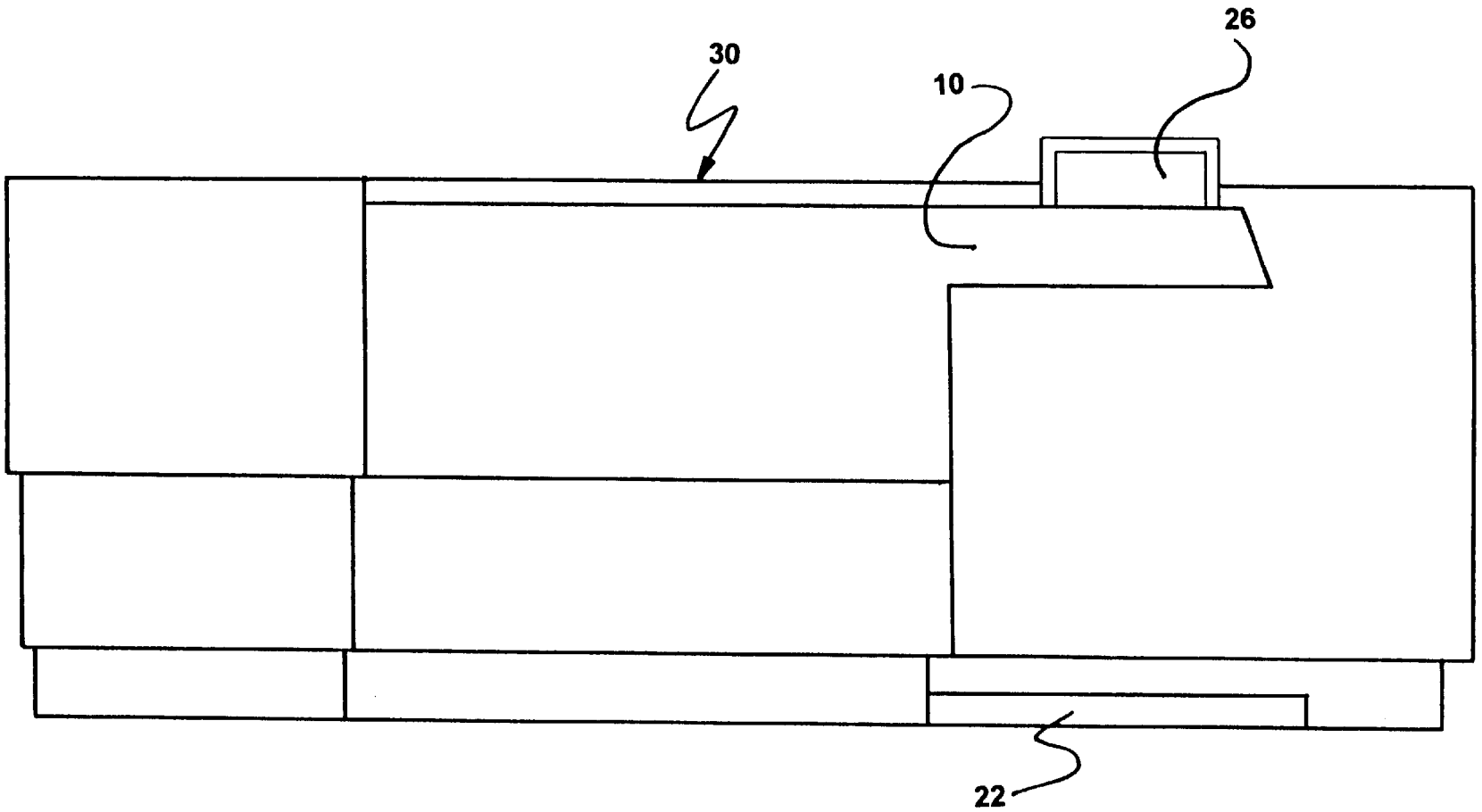
FIG. 2 is a checker side plan view of the BTS check stand without a cart.

FIG. 2 is a checker side view of the BTS check stand without a cart. A deep scanner 26 is shown inside the cantilevered scanner housing 10. The dotted lines illustrate how the body of the scanner 26 recesses into the cantilevered scanner housing 10. The wheel capture guide 22 is shown in a side view.

Figure 3:
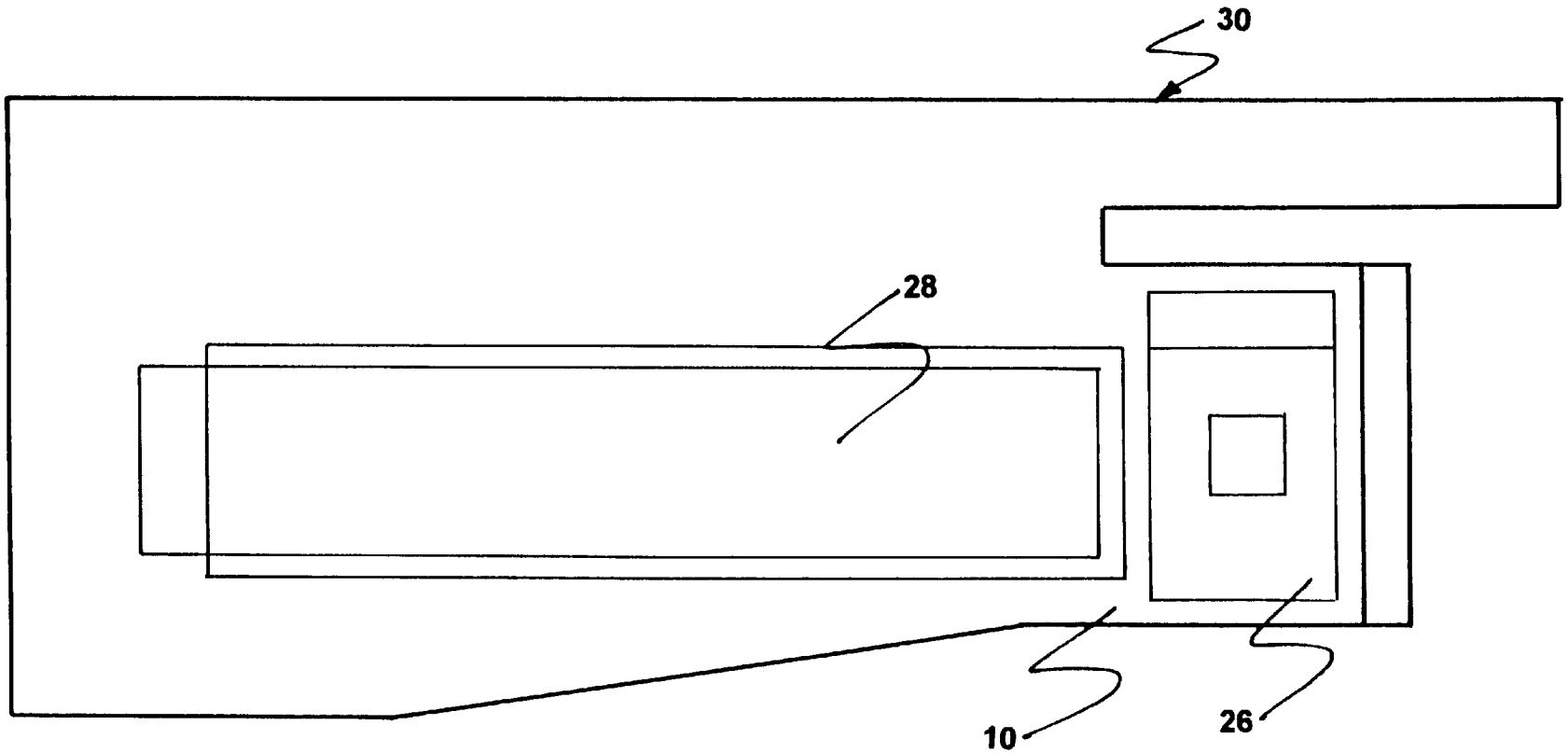
FIG. 3 is a top view of the BTS check stand without a cart.

FIG. 3 is a top view of the BTS check stand without a cart. A deep scanner 26 is shown recessed inside the cantilevered scanner housing 10.

Figure 4:
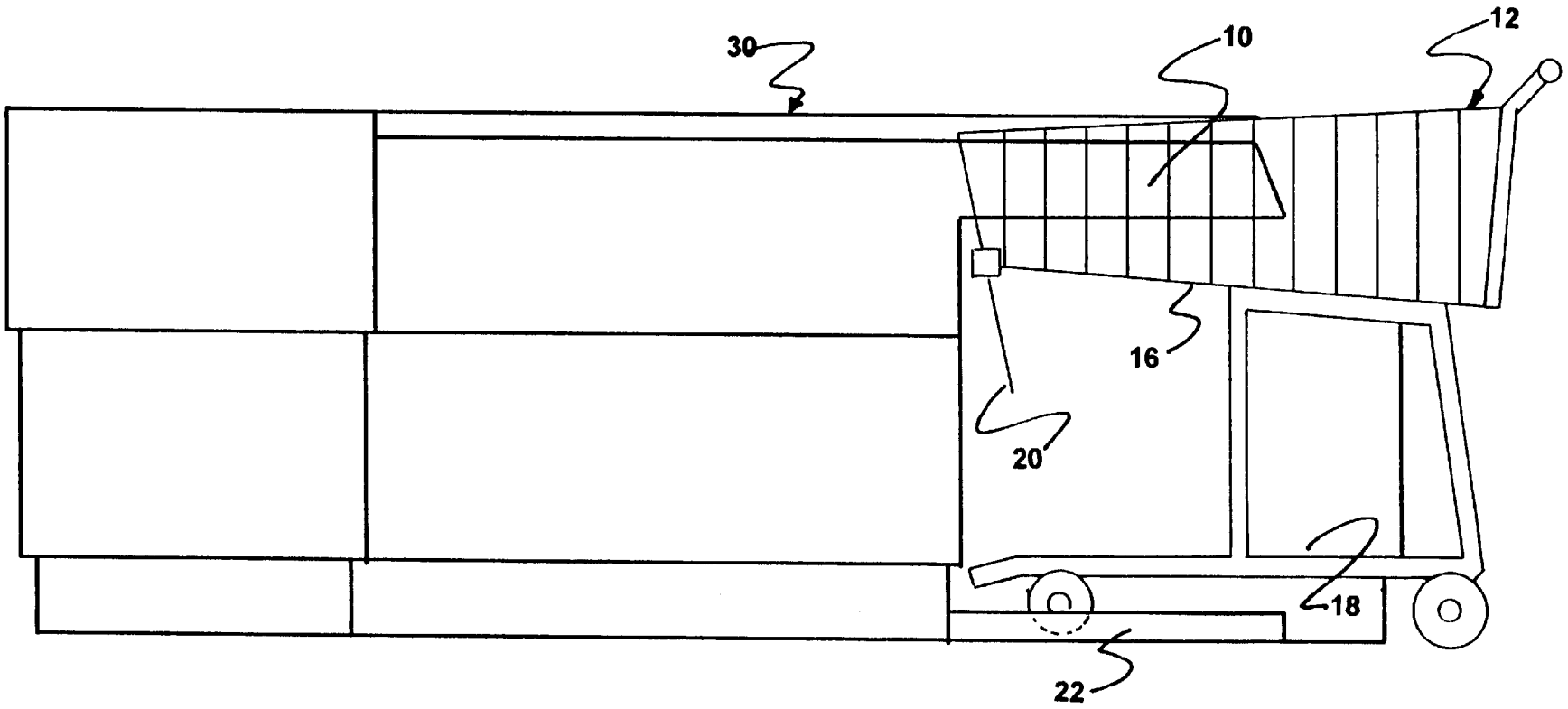
FIG. 4 is a checker side plan view of the BTS system with check stand and narrow nose conventional nesting cart in an extended position under the cantilevered scanner housing.

FIG. 4 is a checker side view of the BTS check stand with a BTS narrow mouth conventional nesting cart. A conventional nesting cart is narrow at the front with tapered sides and wider at the rear. This type cart will nest inside other like carts for storage when not in use. The BTS narrow mouth cart 12 is used for applications where the cantilevered scanner housing 10 is designed to house short scanners up to approximately 16" deep from front to back. The BTS narrow mouth cart 12 is shown fully extended under the cantilevered scanner housing 10. The angled drop-down cart front gate 20 is shown in a lowered position that allows the BTS cart basket bottom 16 to pass under the cantilevered scanner housing 10. The wheel capture cart guide 22 is shown with the front cart wheel captured to allow the cart to move in a straight line under the cantilevered scanner housing 10. The cart bottom tray 18 extended under the cantilevered scanner housing 10 shows the easy access available to items placed on the cart bottom tray.

Figure 5:
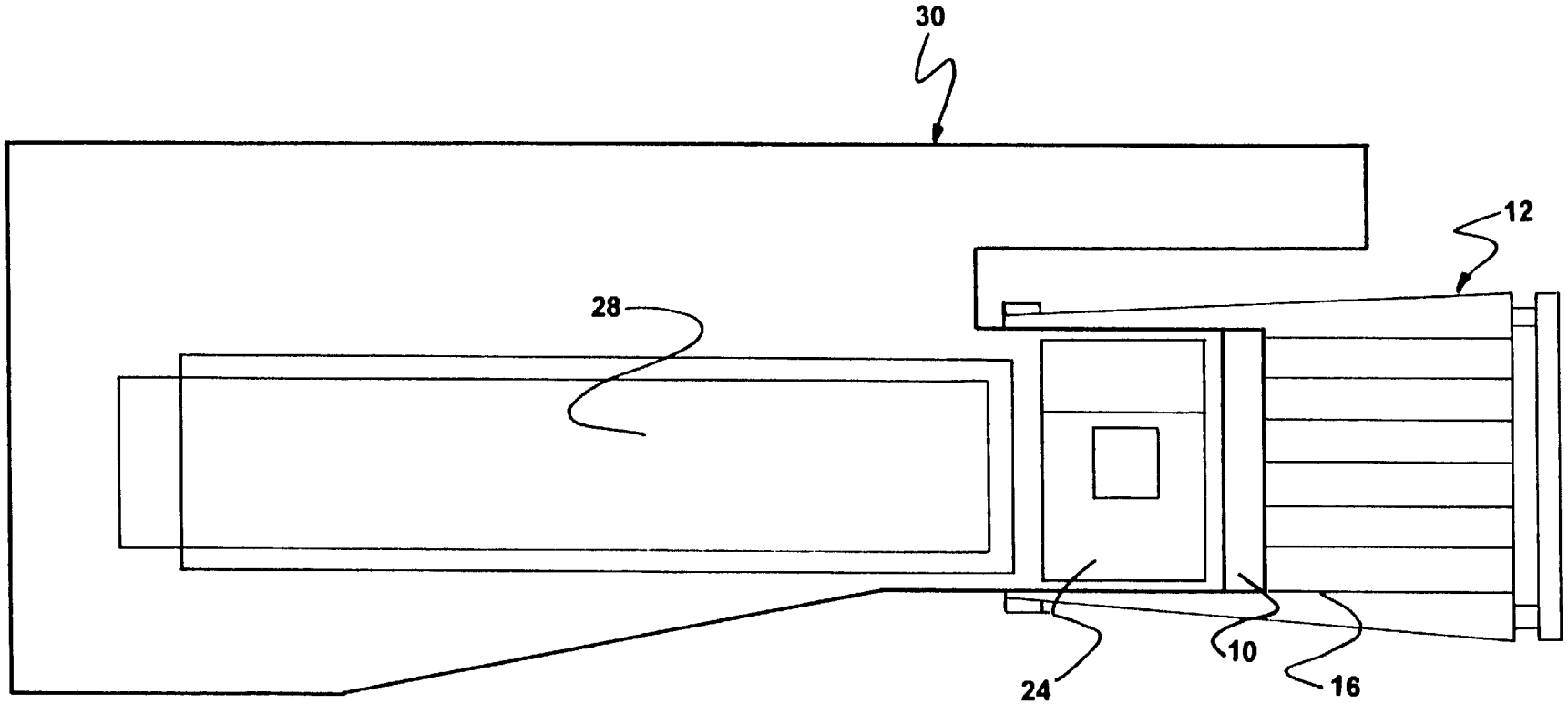
FIG. 5 is a top view of the BTS system with check stand and narrow nose conventional nesting cart in an extended position under the cantilevered scanner housing.

FIG. 5 is a top view of the BTS check stand with a BTS narrow mouth conventional nesting cart. This view illustrates the cart is narrow at the front with tapered sides and wider at the rear. The BTS narrow mouth cart 12 is shown fully extended under the cantilevered scanner housing 10. The dotted line at the front of the cart 12 shows the cart basket bottom 16 passes under the scanner housing 10 to full extension. A short scanner 24 is shown recessed inside the scanner housing 10. FIG. 5 illustrates the reduced reach factors for the checker as product is removed from the cart 12 and passed over the scanner 24 and placed on the take-away belt 28.

Figure 6:
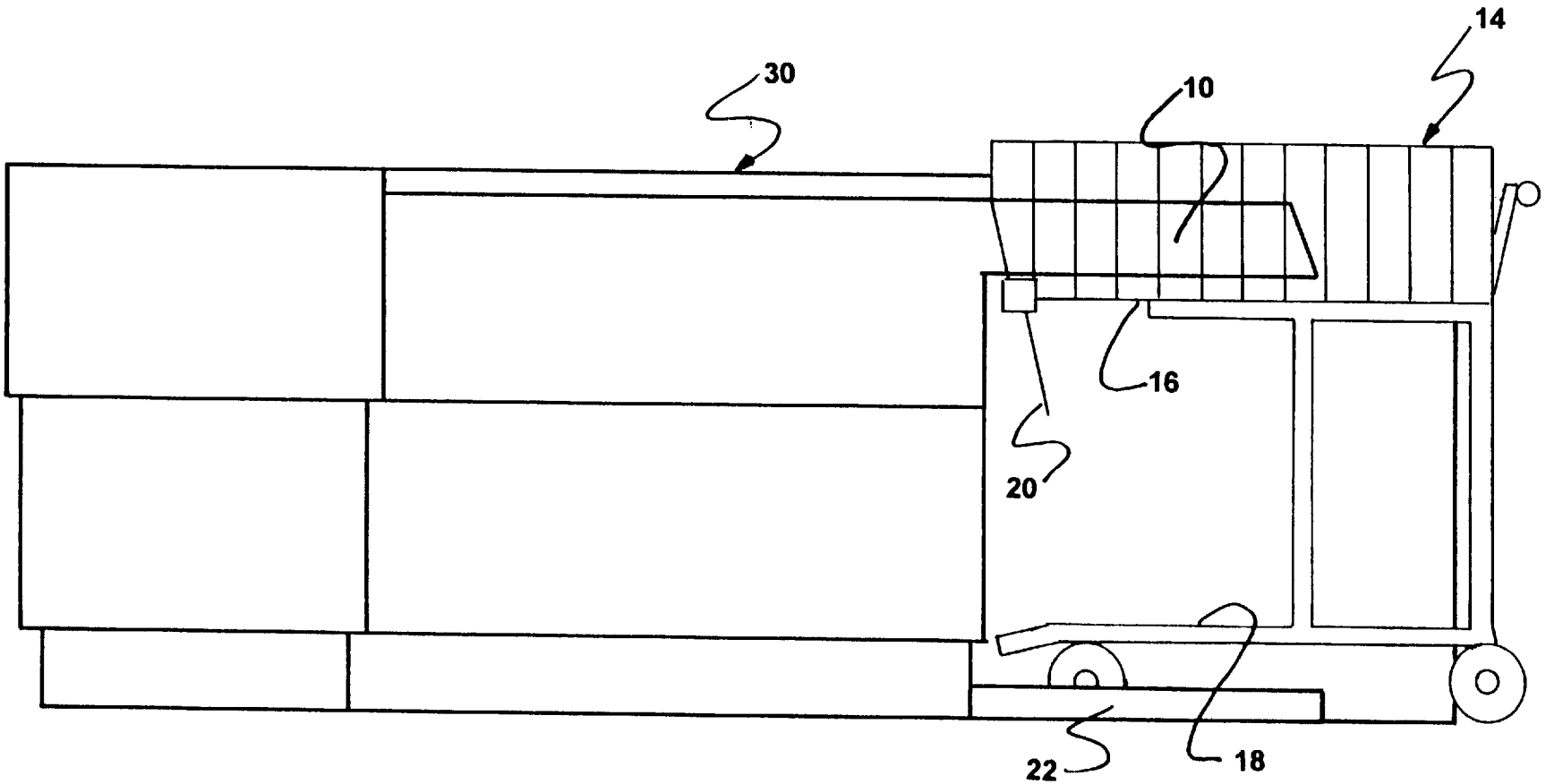
FIG. 6 is a checker side view of the BTS system with check stand and wide mouth over-the-end cart in an extended position under the cantilevered scanner housing.

FIG. 6 is a checker side view of the BTS check stand with a BTS wide mouth over-the-end cart. The BTS wide mouth over-the-end cart 14 is used in applications where the cantilevered scanner housing 10 is designed to house deep scanners up to approximately 21" deep from front to back. The basket bottom of the wide mouth cart 16 is shown extended under the scanner housing 10. The angled drop-down cart gate 20 is shown in a down position that allows the cart basket bottom 16 to pass under the scanner housing 10. A wheel capture cart guide 22 is shown with the front cart wheel captured to allow the cart to move in a straight line under the scanner housing 10. The cart bottom tray 18 extended under the scanner housing 10 allows easy access by the checker to product placed on the cart bottom tray.

Figure 7:
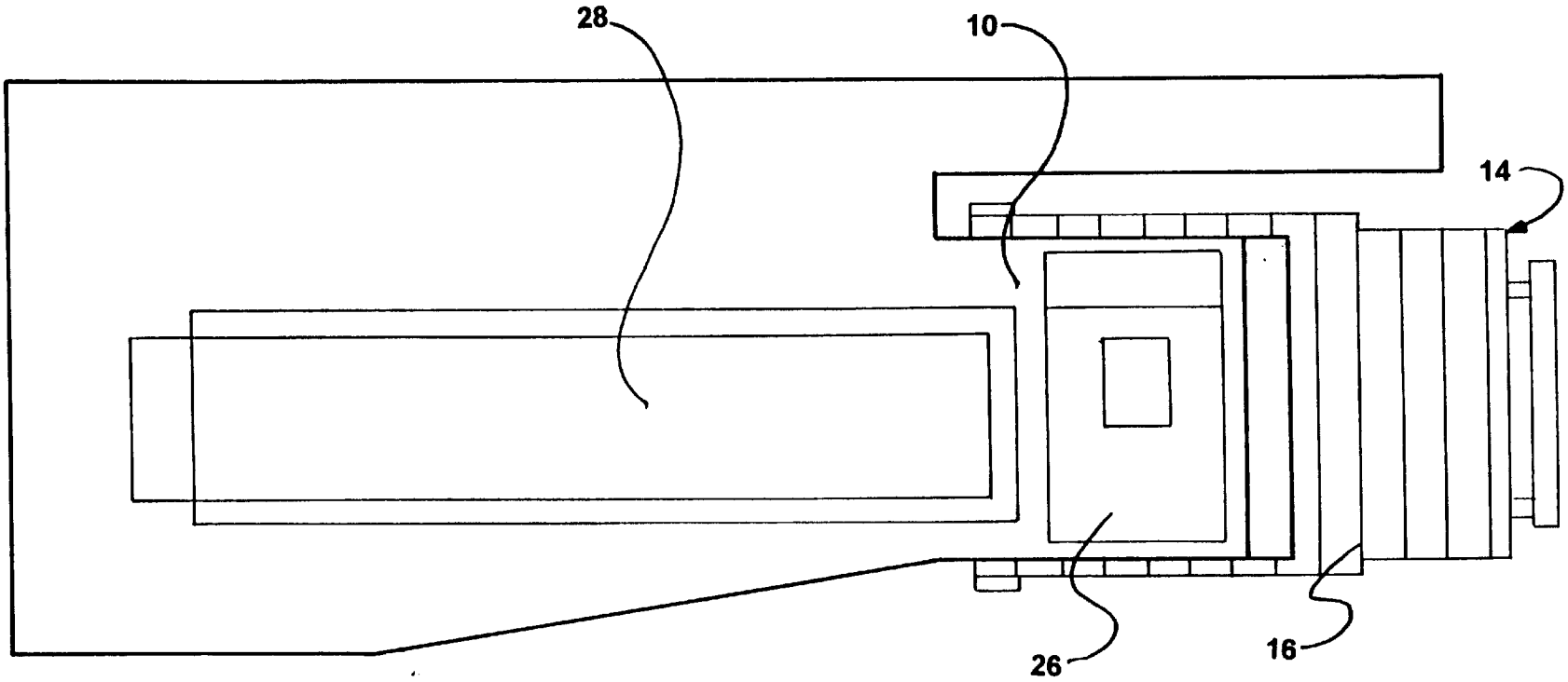
FIG. 7 is a top view of the BTS system with check stand and wide mouth over-the-end cart in an extended position under the cantilevered scanner housing.

FIG. 7 is a top view of the BTS check stand with a BTS wide mouth over-the-end cart. The over-the-end cart has a basket approximately the same width at the front and rear. This type cart nests with other like carts by lifting the basket up at a 90-degree angle. The BTS wide mouth cart 14 is shown fully extended under the cantilevered scanner housing 10. The dotted line at the front of the cart 14 shows the cart basket bottom 16 fully extended under the scanner housing 10. Again, FIG. 7 illustrates the reduced reach factors for the checker as product is removed from the cart 14, passed over the scanner 26 and placed on the take-away belt 28.

Figure 8A:
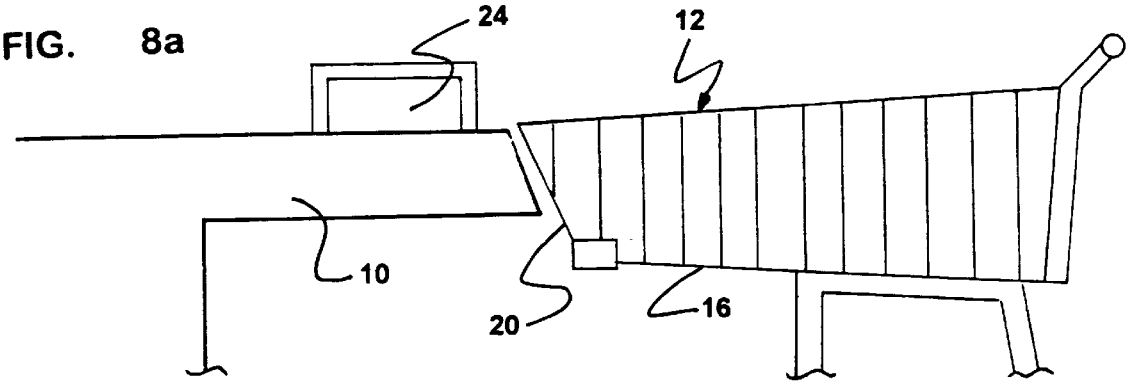
FIGS. 8A–C show initial cart docking position, the cart partially positioned under the cantilevered scanner housing and the cart fully extended under the cantilevered scanner housing.
Figure 8B:
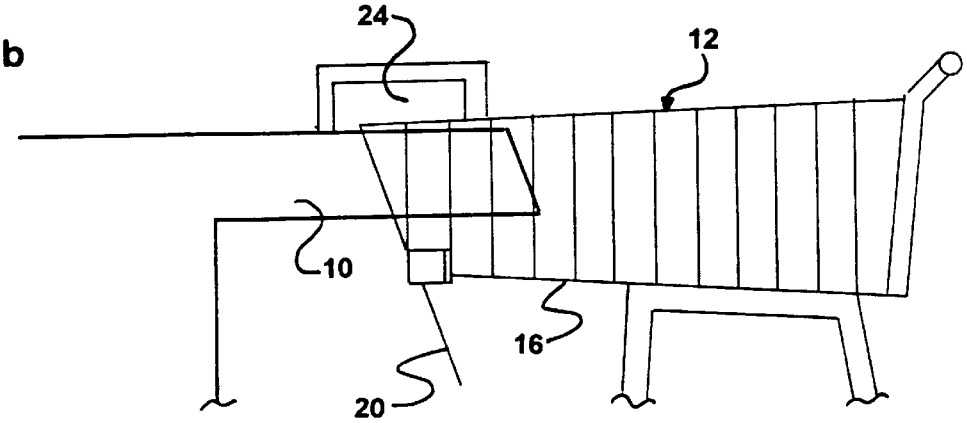
Figure 8C:
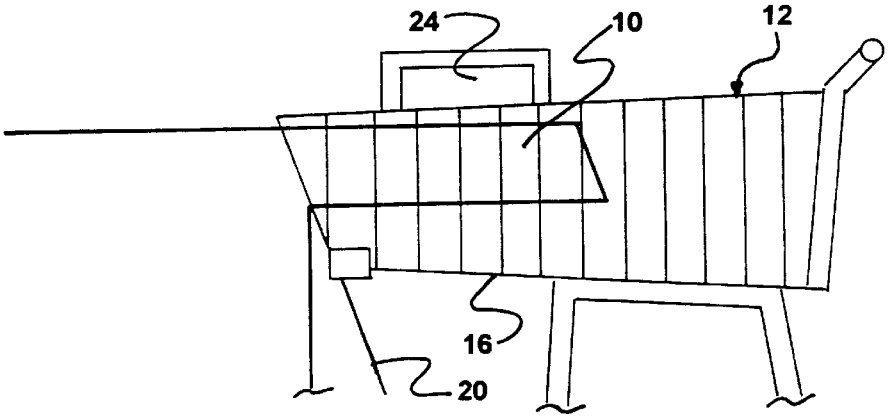

FIG. 8 consists of three partial checker side views of the BTS check stand cantilevered scanner housing and BTS cart.

Position "A" is the position of the cart 12 as it arrives at the cantilevered scanner housing 10. The angled drop-down cart front gate 20 is shown in a closed position abutting the scanner housing 10. The checker removes product from the front of the cart until the gate and front section of the cart are clear.

Position "B" shows the cart 12 in position partially under the scanner housing 10. The angled drop-down gate 20 has been lowered by the checker to allow the cart basket bottom 16 to pass under and partially nest with the scanner housing 10. As the checker removes product from the cart basket the cart is pulled farther under the scanner housing 10 to gain easy access to product in the rear of the cart.

Position "C" shows the cart 12 fully extended under the scanner housing 10. The gate 20 is still in a dropped position allowing the caret basket bottom 16 to pass under the scanner housing 10 and fully nest the check stand scanner housing and cart together. In this fully nested position the scanner housing 10 and scanner 24 are inside the body of the cart 12. In this fully docked position the checker has easy access to the remaining product in the rear of the cart. When all merchandise in the cart is scanned the checker backs the cart out from under the scanner housing closes the front gate and moves the empty cart to the rear of the check stand.

Conclusion, Ramifications, and Scope

The reader can see how the below the scanner check stand/cart system has several advantages for potential users. The primary advantage is the reach reduction for checkers. With the cart capable of passing under the scanner housing several advantages are apparent.

It allows a checker to easily reach all products in a shopping cart thus reducing body strain.

It allows a checker to process more customer orders in a shorter time thus a checker will be more productive in a workday.

Although the descriptions and drawings above show specific details, these should not be construed as limiting the scope of the invention. For example, the check stand or cart could be of varying sizes to accommodate the needs of various retailers.

Thus the scope of the invention should be determined by the appended claims rather than by examples given.

The embodiments of the invention in which an exclusive property or privilege is claimed are defined as follows:

1. A check stand having a cantilevered scanner housing and a shopping cart having a basket bottom that passes beneath said cantilevered scanner housing to form a complete system of a nested check stand and cart comprising:

said check stand with said cantilevered scanner housing into which an optical scanner is recessed and said cantilevered scanner housing being of a size in height, depth and width to fit inside the main basket body of said shopping cart said shopping cart having a front gate that opens to allow the bottom of the cart basket to pass beneath the cantilevered scanner housing of the check stand and said cart having vertical sides which pass on both vertical sides of the cantilevered scanner housing of the check stand.

2. The check stand and shopping cart system as set forth in claim 1, further comprising at least one guide rail mounted to said check stand and located beneath said cantilevered housing for guiding front wheels of said shopping cart.

* * * * *